United States Patent [19]

Simjian

[11] 3,945,637

[45] Mar. 23, 1976

[54] EXERCISE AND MASSAGING APPARATUS

[76] Inventor: Luther G. Simjian, 7 Laurel Lane, Greenwich, Conn. 06830

[22] Filed: Nov. 14, 1974

[21] Appl. No.: 523,565

[52] U.S. Cl. ..... 272/73; 128/25 R
[51] Int. Cl.[2] ..... A61H 1/02
[58] Field of Search ..... 272/73, 79 R, 57 R, 57 A; 128/25 R, 63, 58

[56] References Cited

UNITED STATES PATENTS 3,727,608 4/1973 Simjian ..... 272/73

FOREIGN PATENTS OR APPLICATIONS 238,867 10/1911 Germany ..... 128/63

*Primary Examiner*—Richard C. Pinkham
*Assistant Examiner*—William R. Browne

[57] ABSTRACT

An exercise and massaging apparatus comprises a bicycle type apparatus with pedals. The motion imparted to the pedals is coupled to a massaging belt worn by the person using the apparatus. Angularly adjustable apparatus is provided to control the motion of the massaging belt and providing the massaging action. The massaging belt is connected to disks that are mechanically rotated. The belt ends are alternately pulled and relaxed during the rotations of the disks.

10 Claims, 7 Drawing Figures

EXERCISE AND MASSAGING APPARATUS

SUMMARY OF THE INVENTION

This invention is related to exercise and massaging apparatus as previously disclosed by me in U.S. Pat. Nos. 3,670,723; 3,727,608; 3,777,745; pending applications for U.S. Letters Patent Ser. No. 405,406 filed Oct. 11, 1973, now U.S. Pat. No. 3,861,382 dated Jan. 21, 1975; Ser. No. 487,050 filed July 10, 1974, and Ser. No. 496,307 filed Aug. 9, 1974.

The above referenced patents and pending applications disclose exercise apparatus which are combined with a massaging means so that a person operating the particular apparatus for the purpose of subjecting himself to exercise receives simultaneously a massage. The intensity of the massaging action is directly related to the muscular effort expended by the person during such exercise. The exercise apparatus of the type indicated above comprises typically, a stationary bicycle, and a massaging means which, as shown previously, includes resilient roller means mounted to a massaging belt. The massaging belt is operated to undergo reciprocating motion in response to the operation of foot pedal means which form a part of the simulated bicycle structure.

The present invention is more closely related to the apparatus shown in patent application Ser. No. 405,406 supra and includes constructional features with a view of achieving an exercise and massaging apparatus of simplified construction, particularly one which is extremely simple to manufacture and easy to maintain by the user. Therefore, certain economies result which provide an exercise and massaging apparatus of low cost and easy availability for the mass market.

Other specific features of the present invention will be more clearly apparent from the following description when taken in conjunction with the accompanying drawings.

DETAILED DESCRIPTION OF THE INVENTION

Figure 1:
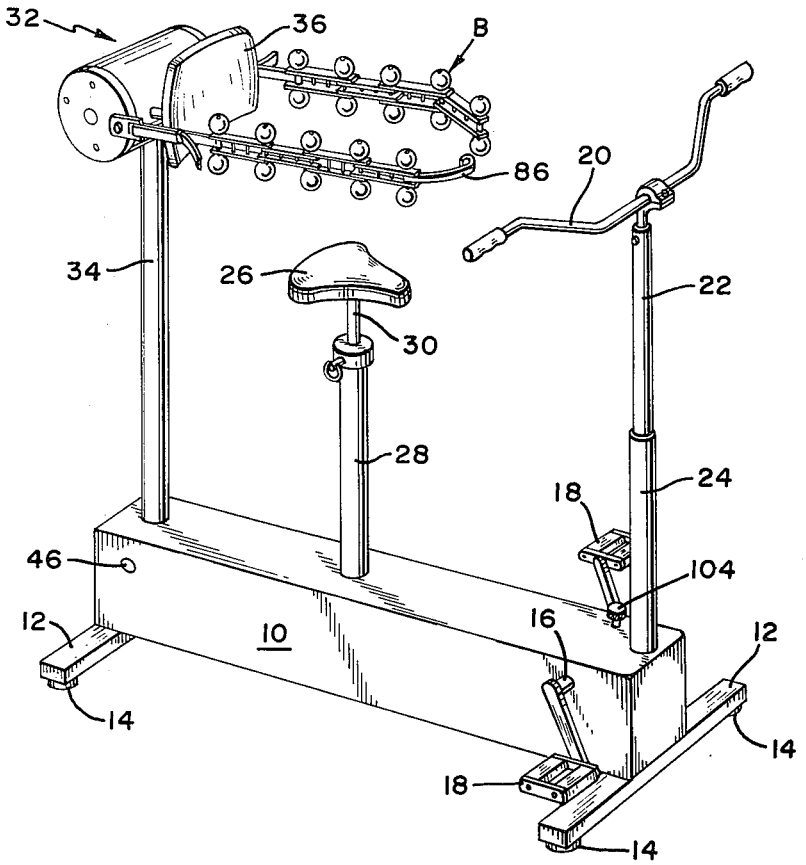
FIG. 1 is a perspective view of the exercise and massaging apparatus in accordance with the present invention.

Referring now to the figures and FIG. 1 in particular, numeral 10 identifies a support structure which rests on the ground or some other stationary support by means of a pair of braces 12, each of which carries a set of feet 14. The support structure 10 of box shape journals a pedal crank shaft 16 which is provided at either end with a respective pedal 18. The support structure supports, moreover, a handle bar 20 which is elevated from the support structure 10 by means of a telescoping set of tubes 22 and 24, a seat 26 which is elevated from the structure 10 by means of a tube 28 and rod 30, and a massaging belt drive mechanism 32 elevated from the support structure 10 by means of a tubing 34. The tubing 34 supports also a back rest 36 for providing that a person sitting on the seat 26 and resting against the back rest 36 while holding onto the handle bar 20 is secure and in a comfortable position. A massaging belt B is coupled to the drive mechanism 32 to undergo motion and, as shown in FIG. 1, the belt B is adapted to fit around the torso of a person sitting on seat 26 to provide a massaging action.

Figure 5:
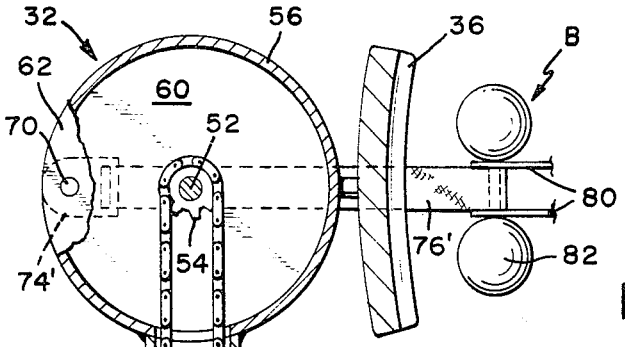
FIG. 5 is a sectional view through the major portion of the apparatus for depicting the transfer of the rotational motion from the pedal means to the belt drive mechanism.
Figure 6:
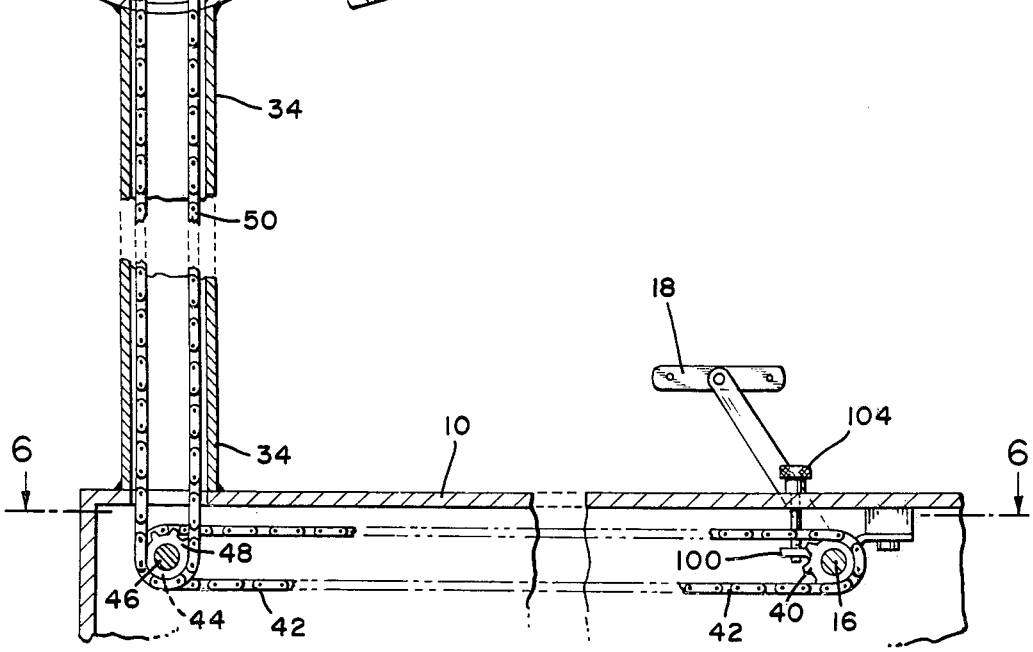
FIG. 6 is a sectional view along line 6—6 in FIG. 5.

Referring also to FIGS. 5 and 6 in particular, the rotation imparted to the pedal shaft 16 responsive to the motion provided by the person subjecting himself to exercise is transferred from the shaft 16 via a sprocket gear 40 secured to the shaft 16 and sprocket chain 42 to a sprocket gear 44 affixed to a shaft 46 which is journalled in bearings fastened to the side of the support structure 10. A further gear 48 secured to the shaft 46 transmits via sprocket 50 disposed inside the tube 34 the rotation from shaft 16 to shaft 52 which has a sprocket gear 54 affixed thereupon. The shaft 52, elevated from the support structure 10, is journalled in the side of a cylinder 56 which is supported in its elevated position from the structure 10 by means of the upstanding tubing 34.

It will be apparent that the sprocket gears and sprockets may be replaced by pulleys and belts or other drive means in a manner to transfer the rotational motion imparted to shaft 16 to rotating motion on shaft 52 which is disposed in a generally horizontal plane elevated from the support structure 10.

Figure 2:
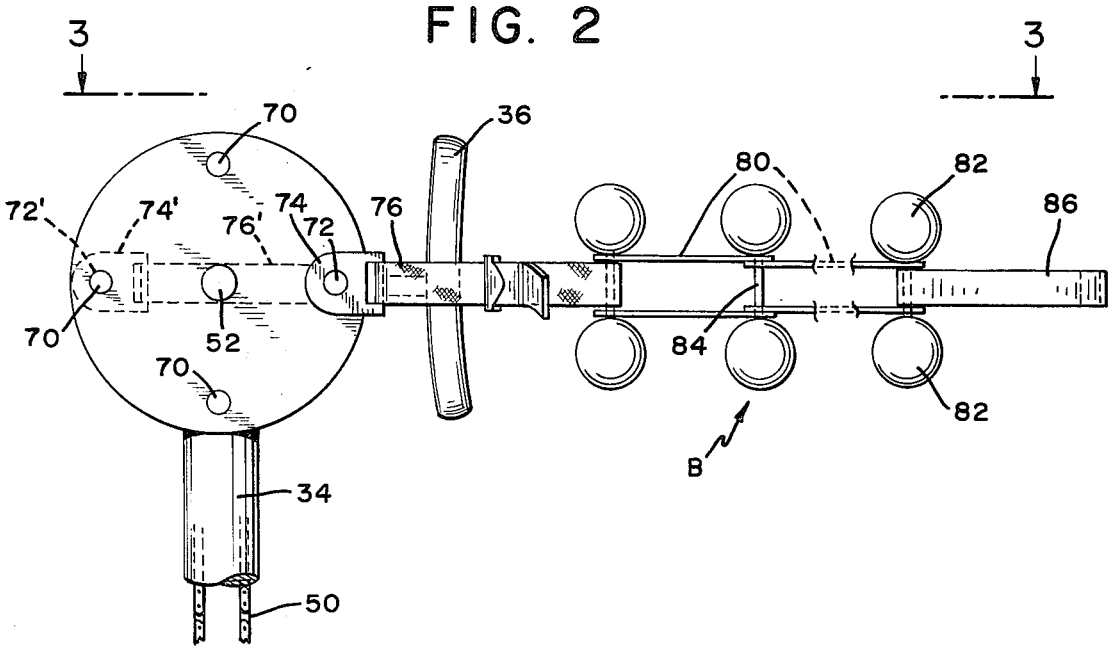
FIG. 2 is a side view showing the massaging belt and its attachment to the drive mechanism.
Figure 3:
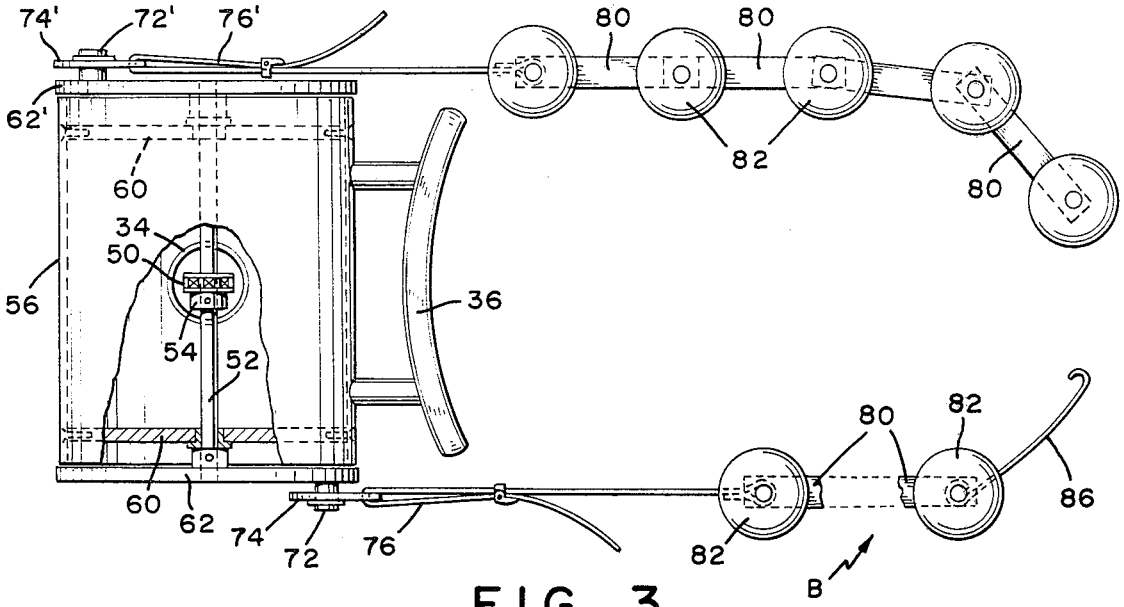
FIG. 3 is a view along line 3—3 in FIG. 2.

As more clearly seen in FIG. 3, the shaft 52 is journalled in a pair of side plates 60 which are supported by the cylinder 56. The shaft 52 has attached to it at its ends respectively a disk 62 and disk 62' which cover the ends of the cylinder 56 on each side. The disks 62 and 62', rotated by shaft 52, are provided, typically, with four circumferentially spaced holes 70, see FIG. 2. Each of the holes 70 is adapted to receive a stud 72, which in turn is adapted to support around its shank a link 74 to which the end 76 of the belt B is fastened, as seen in FIG. 3. With reference to the same figure the second end 76' of the belt B is fastened to the link 74' which is secured to the disk 62' by a stud 72'.

Figure 4:
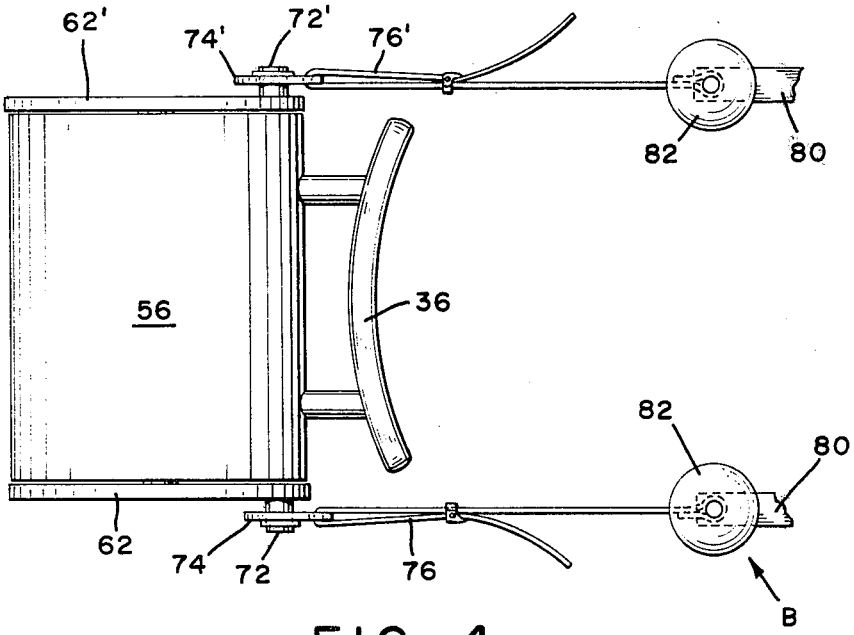
FIG. 4 is a view similar to FIG. 3 but showing a change of the attachment of the belt to the drive means.

As seen in FIG. 3 the ends of the belt B are fastened to the disks 62 and 62' in such a manner that there is a 180° rotational difference to cause, responsive to the rotation of shaft 52, the belt B to undergo a reciprocating side-to-side motion, that is, one belt end is pulled while the opposite belt end is paid out. As seen in FIG. 4, the belt ends 76 and 76' are secured to the respective disks 62 and 62' in such a way that the rotational position of the belt ends on the disks is the same, causing both ends of the belt to be simultaneously pulled and subsequently paid out, thereby causing a cyclic tightening and relaxing of the belt. Such change of the belt arrangement is possible, of course, by virtue of the holes 70 in the side of the disks and selectively inserting the respective stud in a selected aperture. It should be noted that by virtue of the belt ends undergoing rotation in a vertical plane, the massaging belt B is subjected to a compound, vertical-horizontal motion manifest upon the person wearing the belt.

The massaging belt, in the preferred embodiment, is constructed in accordance with the design more clearly illustrated in U.S. Patent Application Ser. No. 405,406, comprising a plurality of pivotally mounted links 80 each of which is fitted with one or more massaging elements 82 made of resilient or semi-hard material. The individual massaging elements, responsive to the motion imparted to the belt, are adapted to rotate, being secured to respective tubing 84 which serve also as a pivot for the individual links 80. Furthermore, the belt is provided with a closure, comprising a hook 86 or similar construction as seen in FIGS. 1 and 3.

Instead of securing both ends of the belt to a respective disk which is rotated, it will be apparent that one end of the belt may be attached to the tubing 34 so that a pulling and paying out motion is only effective upon one of the belt ends. Preferably, the fixed end is secured to the tubing 34 by means of a spring to avoid pain or injury to the operator before adjustment of the motion has been made. It will be apparent, furthermore, that by providing the respective holes 70 at different distances from the rotational axis of shaft 52, varying amounts of excursion of the belt ends may be achieved. Furthermore, the tubing 34 together with the belt drive mechanism, instead of being rotated behind the seat 26, may be located also in the space between the seat 26 and the handle bar 20. Another alternative arrangement comprises the use of a double ended crank shaft instead of the disks 62 and 62' being attached to a straight shaft 52.

Figure 7:
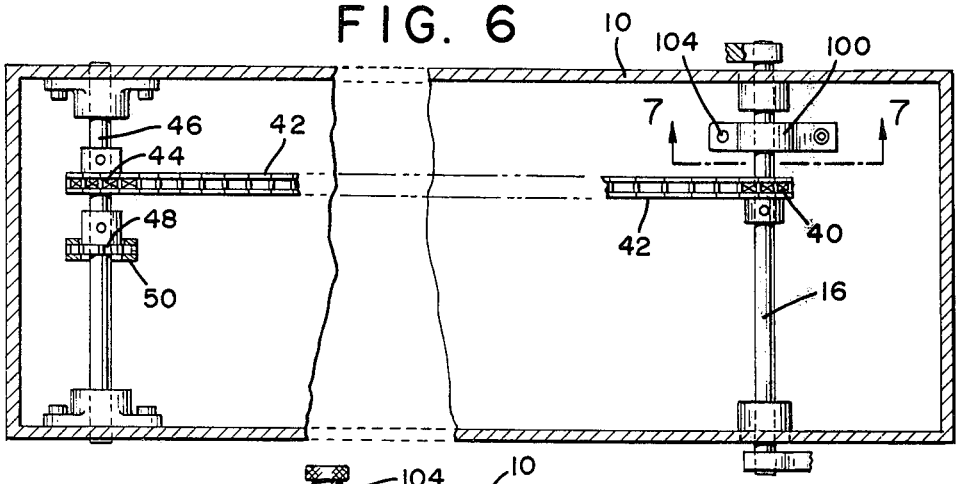
FIG. 7 is a sectional view along line 7—7 in FIG. 6.
Figure 7:
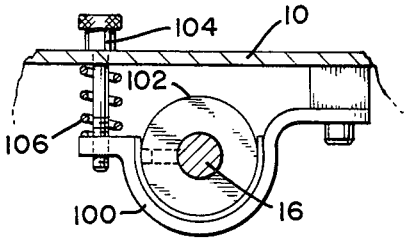

With reference to FIG. 7 there is shown a brake mechanism in order to vary the muscular effort required by the operator to impart rotation upon the shaft 16. The brake mechanism comprises a yoke 100 which is equipped with a brake lining for frictionally engaging a disk 102 attached to the shaft 16. The braking force is varied by means of a screw adjustment 104 and spring 106, the latter forcing the yoke 100 away from the disk 102 when the screw 104 is turned so as to diminish the braking force applied. Frictional braking devices of this type are well known in the art and have been described by me previously in one or more of the patents noted hereinabove.

What is claimed is:

1. An exercise and massaging apparatus comprising:
a stationary support structure;
pedal means including a first rotatable shaft for being operated by a person coupled to said support structure;
a seat elevated from said structure disposed rearward of said pedal means for accommodating a person operating said pedal means;
a massaging belt having massaging elements for engaging a body portion of a person operating said pedal means when said belt is worn by a person;
a second rotatable shaft mounted for rotation about a substantially horizontal axis elevated from said support structure;
means coupling said first and second shafts to one another for causing the rotation of said first shaft to be transferred to said second shaft;
rotatable means coupled to said second shaft for rotation therewith, and
means disposed on said rotatable means for coupling said belt to said rotatable means for causing said belt to be subjected to cyclic reciprocating side-to-side motion responsive to the rotation of said second rotatable shaft.

2. An exercise and massaging apparatus as set forth in claim 1, the axis of said second shaft being elevated with respect to said seat.

3. An exercise and massaging apparatus as set forth in claim 1, said rotatable means comprising a pair of disks, and said means for coupling fastening one belt end to one of said disks and the other belt end to the other one of said disks.

4. An exercise and massaging apparatus as set forth in claim 3, said disks and means for coupling being constructed to selectively fasten said belt ends to said respective disks at the same or at different angular positions on said respective disks.

5. An exercise and massaging apparatus as set forth in claim 1, and including a handle bar elevated from said support structure.

6. An exercise and massaging apparatus as set forth in claim 5, and brake means coupled for adjusting the effort required by a person in operating said pedal means to cause rotation of said first shaft.

7. An exercise and massaging apparatus comprising:
a support structure;
pedal means including a rotatable shaft for being operated on by a person coupled to said support structure;
a seat elevated from said structure disposed rearwardly of said pedal means for accommodating a person operating said pedal means;
a massaging belt having messaging elements for engaging a body portion of a person operating said pedal means when said belt is worn by a person;
rotatable means mounted for rotation about a fixed center elevated from said support structure;
means coupling the rotation of said rotatable shaft to said rotatable means, and
further means coupling said belt to said rotatable means for causing responsive to the rotation of said rotatable means one end of said belt to be pulled while the other belt end is being paid out.

8. An exercise and massaging apparatus as set forth in claim 7, said rotatable means including a rotatable shaft with at least one rotatable means affixed thereupon for rotation with said shaft, and securing means disposed on said rotatable means for securing thereto at least one end of said belt.

9. An exercise and massaging apparatus comprising:
a support structure;
pedal means including a rotatable shaft for being operated by a person coupled to said support structure:
a seat elevated from said structure disposed for accommodating the person operating said pedal means;
a massaging belt having massaging elements for engaging a body portion of the person operating said pedal means when said belt is worn by such person;
rotatable means mounted for rotation about a fixed center elevated from said support structure;
means coupling the rotation of said rotatable shaft to said rotatable means, and
means coupling said belt to said rotatable means for causing responsive to the rotation of said rotatable means one part of said belt to be pulled while the other part is being paid out.

10. An exercise and massaging apparatus as set forth in claim 9, said rotatable means including a rotatable shaft with at least one rotatable means affixed thereupon for rotation with said shaft, and securing means disposed on said rotatable means for securing thereto at least one part of said belt.

* * * * *